US007481208B2

(12) United States Patent
Erickson

(10) Patent No.: US 7,481,208 B2
(45) Date of Patent: Jan. 27, 2009

(54) SNOWBALL FORMING AND THROWING TOY

(76) Inventor: Duane Erickson, 1908 W. Center St., Evanston, WY (US) 82931

( * ) Notice: Subject to any disclaimer, the term of this patent is extended or adjusted under 35 U.S.C. 154(b) by 229 days.

(21) Appl. No.: 11/474,319

(22) Filed: Jun. 26, 2006

(65) Prior Publication Data

US 2007/0295317 A1 Dec. 27, 2007

(51) Int. Cl.
*F41B 3/00* (2006.01)

(52) U.S. Cl. ..... 124/5

(58) Field of Classification Search ..... 124/4, 124/5

See application file for complete search history.

(56) References Cited

U.S. PATENT DOCUMENTS 3,115,129 A * 12/1963 Merriman ..... 124/5
3,472,217 A 10/1969 Erickson ..... 124/5
5,000,153 A 3/1991 Zimmerman et al. ..... 124/5
5,522,372 A * 6/1996 Gerstikov ..... 124/5

OTHER PUBLICATIONS

Exhibit "A" Advertising Flyer; Title SNO Fling; 1 page; Published Oct. 1, 1970.

* cited by examiner

*Primary Examiner*—John Ricci

(57) ABSTRACT

A toy for use in forming and throwing snowballs and including an interiorly patterned cup portion to loosen packed snowballs that could injure a person targeted with the discharging snowball; a smooth inner bore adjacent the discharge end of the cup; a hollow handle with control holes to be opened and closed to increase throwing accuracy, and for use in bugling; a handle knob to provide for better grasping of the toy during throwing of a formed snowball, and including an open end to serve as a mouthpiece when the toy is used as a bugling-type noise maker.

8 Claims, 3 Drawing Sheets

SNOWBALL FORMING AND THROWING TOY

CROSS-REFERENCE TO RELATED APPLICATIONS

Figure 1:
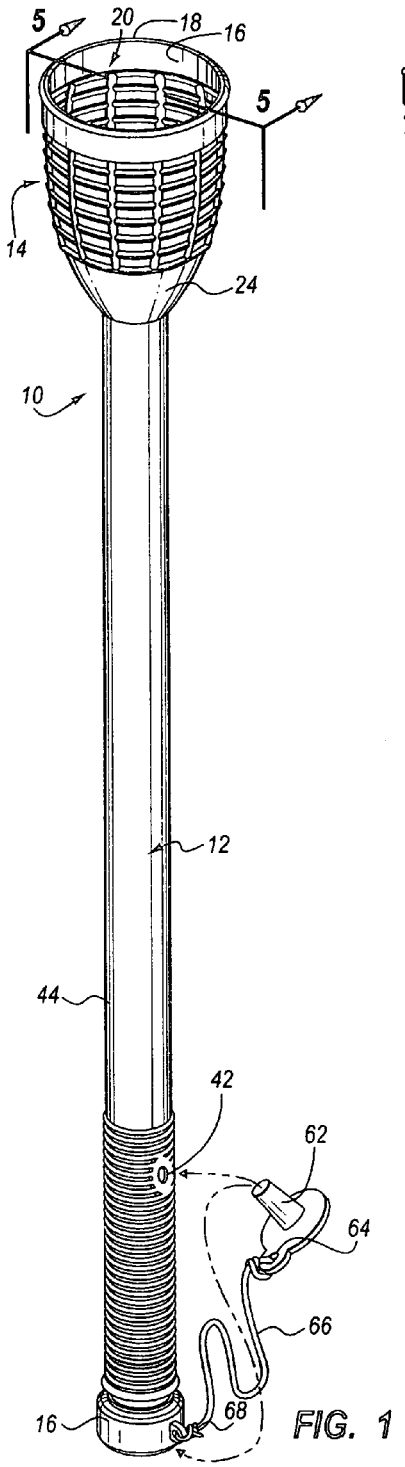

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

Field of the Invention

This invention is a snowball forming and throwing toy for use by people of all ages. It is, however, generally a toy for use by children.

Snowball forming and throwing toys have been known in the past. Such toys generally provide an elongate tubular handle that is closed at one end and flared to an enlarged, smooth bore, open-ended cup. In use the handle is grasped and the enlarged open end is pushed into snow so that snow is compacted into the enlarged cup. The compacted snow is then discharged from the enlarged open end towards a target, or for a desired distance, by the user grasping the handle and whipping the enlarged end to a desired direction for flight of the snowball emerging from the enlarged open end.

It is well recognized that a solid snowball, and particularly one made of heavy wet or slushy snow compacted into the flared, smooth bore, open end cup of a snowball forming and throwing toy, is more likely to injure a person hit by the projected snowball than will a projected snowball that is more loosely packed. It has been found that a cup bore having both a properly patterned portion and a smooth portion will result in an otherwise dangerously hard packed snowball partially breaking apart as it discharges from the toy and during flight. The breaking snowball travels towards a target, while retaining sufficient mass and collective shape, to less dangerously impact the target.

Snowballs that are formed and firmly packed into the flared open cup end of a snowball forming toy by insertion of the flared open cup end into accumulated snow, are best controlled during discharge by releasing compressed air from the handle of the toy during snowball forming; preventing air flow into the handle during initial throwing action, and permitting the air to flow into the hollow handle when it is desired to release the snowball from the cup.

In using snowball forming and throwing toys in the past, the accuracy of thrown snowballs has been affected by the reduced pressure developed in the hollow, tubular handle as the packed snowball is discharged by a throwing motion. Better throwing accuracy is achieved if a snowball is retained until it is discharged at a selected time during the throwing motion by equalizing pressure in front and behind the snowball.

OBJECTS OF THE INVENTION

Principal objects of the snowball forming and throwing toy are to form a packed snowball and to release the packed snowball as safely and accurately as possible.

Other objects are to provide a snowball forming and throwing toy that will break up dangerously formed snowballs that might otherwise injure a person hit by such a snowball. At the same time, it is an object to provide a toy that will allow softer packed snow to retain a ball shape when projected.

Still another object is to provide a snowball forming and throwing toy that will allow a formed snowball to be quickly released at a chosen time during the throwing movement of the toy.

FEATURES OF THE INVENTION

Principal features of the invention include an elongate tubular handle opening at one end into a flared snowball forming cup.

The forming cup has a patterned portion with lands and grooves therein that will break up icy snowballs formed in the cup and that will have little effect on softer snowballs. A smooth base portion of the inner wall of the cup is flared slightly outward to direct all broken up parts of a discharging snowball into the same direction as the snowball flies from the cup.

Other features of the invention include control holes that are used to control air flow into and out of the hollow handle, and a plug to be selectively inserted into the holes during forming and throwing of snowballs. The holes serve an additional function of allowing the toy to be used as a bugle-type snow maker. For this purpose a hole in the end of the handle opposite to the cup opens to a flared opening in a knob at the flared opening to provide proper positioning of a user's lips during bugling.

Additional objects and features of the invention will become apparent to those skilled in the art to which the invention pertains from the following detailed description, drawings and claims.

THE DRAWINGS

In the Drawings

Figure 2:
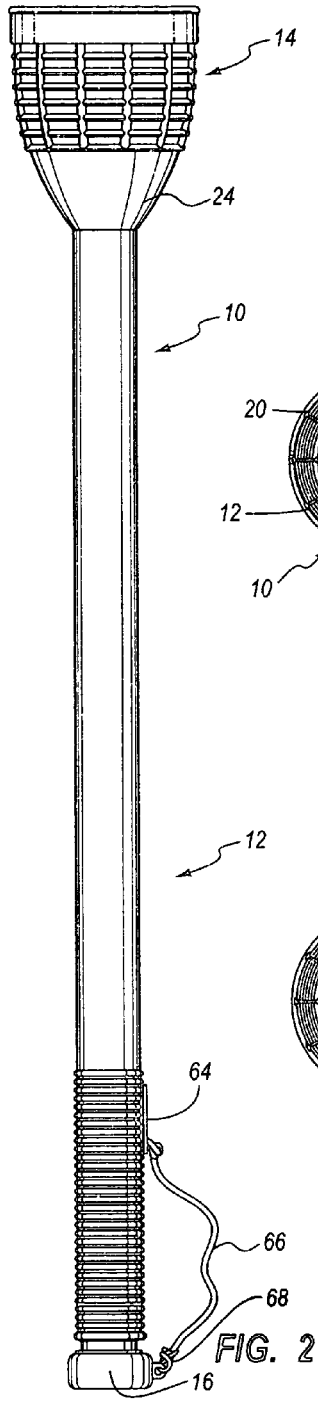
Figure 3:
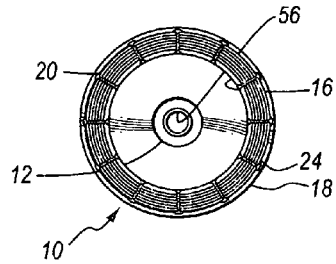
Figure 4:
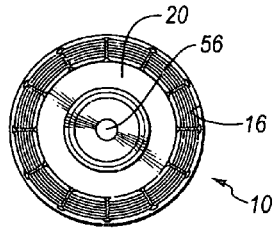
Figure 6:
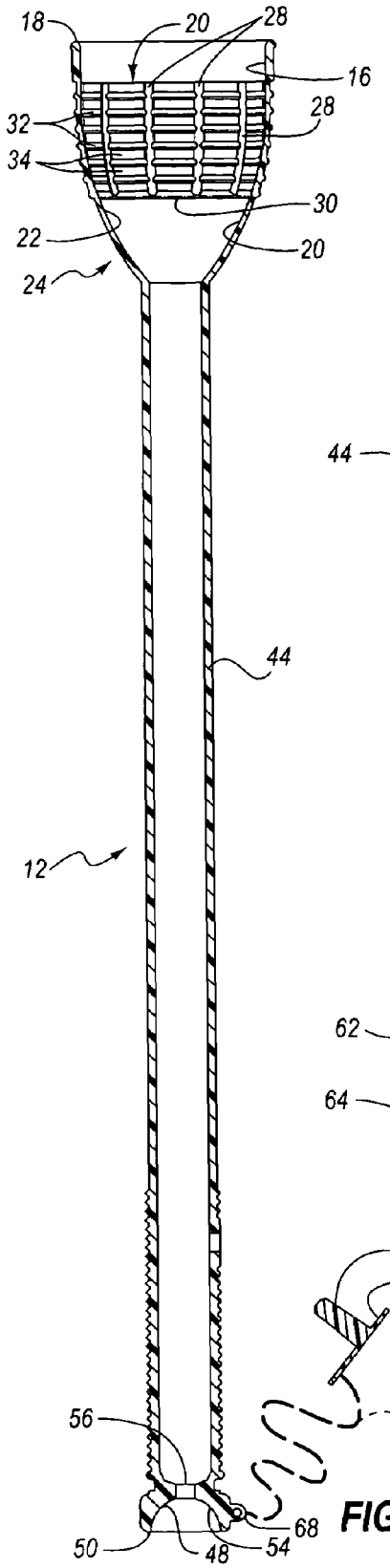
Figure 6:
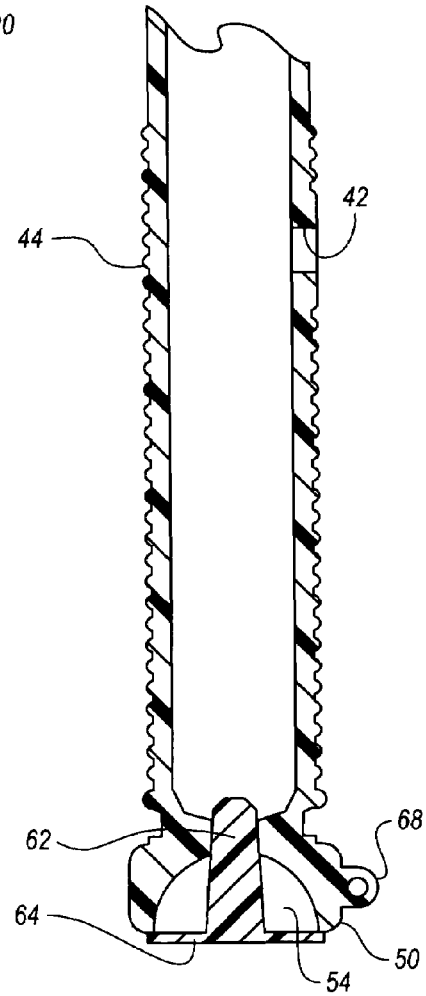
Figure 7:
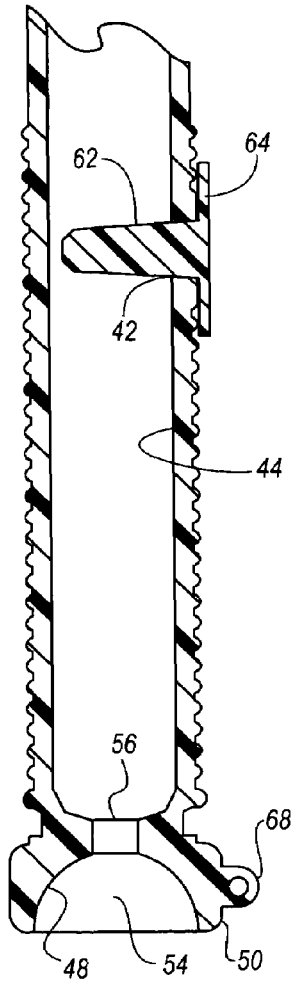
Figure 5:
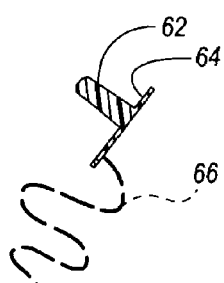
Figure 8:
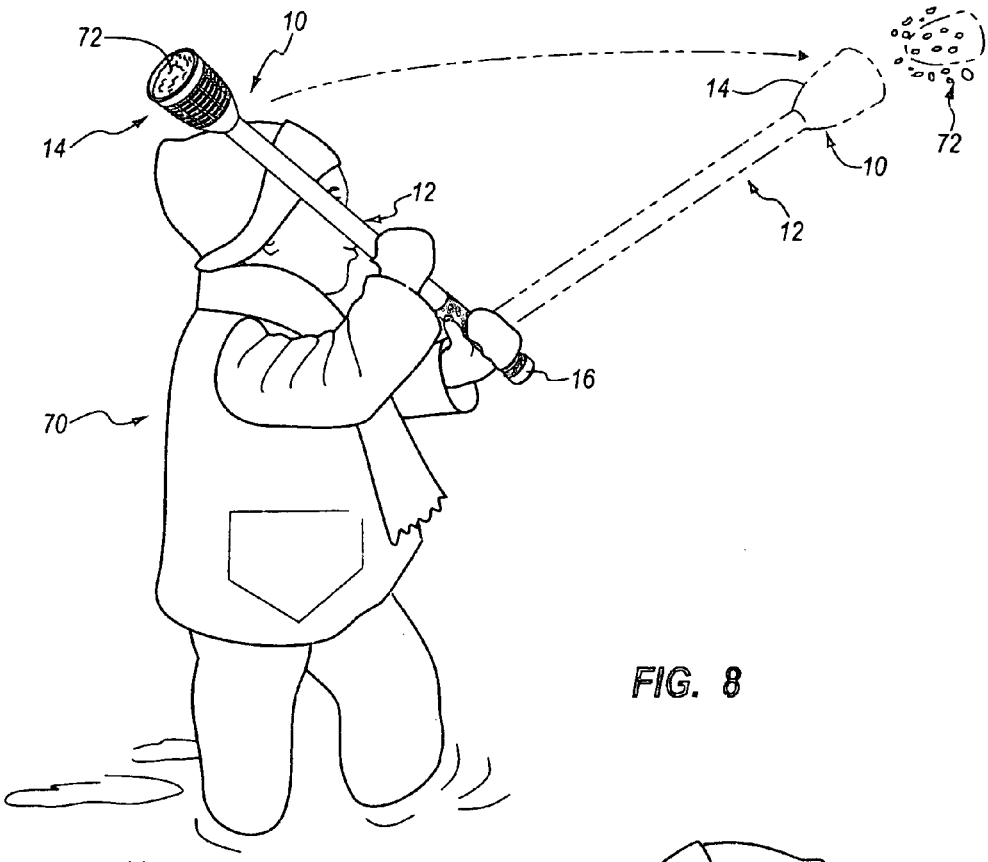

FIG. 1 is a perspective view of a snowball forming and throwing toy of the invention, with the travel paths of the tethered plug shown with broken lines;

FIG. 2, a front elevation view with the plug inserted in the hole in the side wall of the handle;

FIG. 3, a bottom plan view;

FIG. 4, a top plan view;

FIG. 5, a vertical section, taken on the line 5-5 of FIG. 1;

FIG. 6, an enlarged fragmentary central section through the handle end of the toy, with the plug inserted into the hole at the end of the handle remote from the cup;

FIG. 7, a view like that of FIG. 5, but with the plug inserted into the side wall of the handle;

FIG. 8, a pictorial view showing the toy in use for snowball throwing; and

Figure 9:
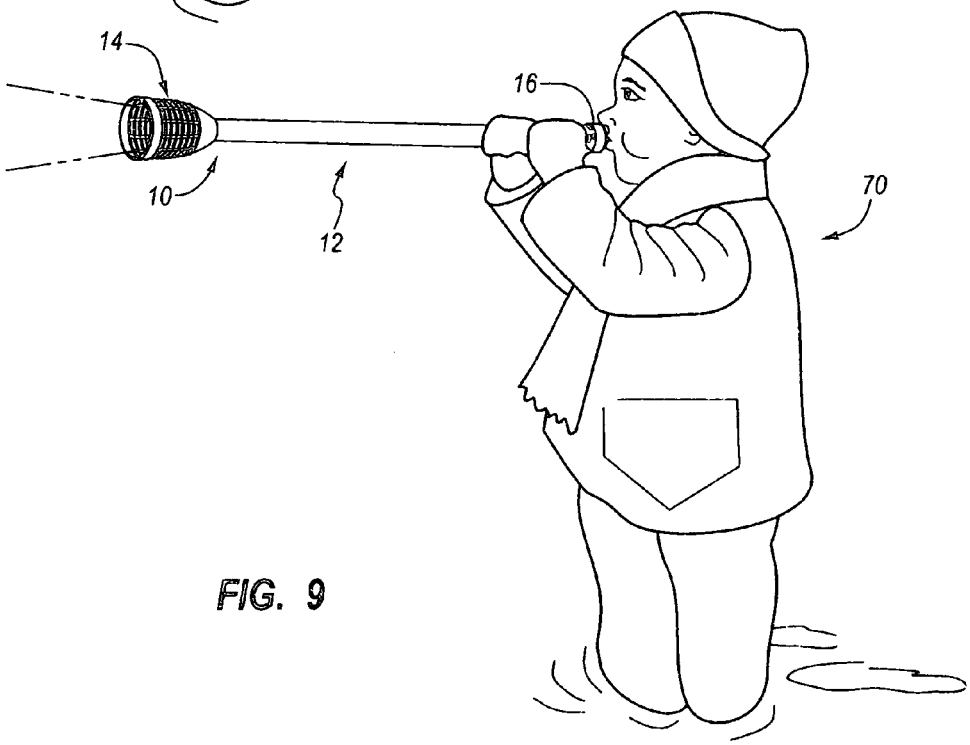

FIG. 9, a view like that of FIG. 7, showing the toy in use for bugling.

DETAILED DESCRIPTION

Referring now the Drawings

In the presently preferred embodiment of the invention, the toy, shown generally at 10, includes an elongate hollow handle 12 with an enlarged flared cup 14 formed at one end. A knob 16 is formed at the opposite end of the handle.

Cup 14 has a smooth inner bore wall exit portion 16 that extends from the outermost edge 18 of the cup interiorly to a patterned inner wall portion shown generally at 20. Patterned wall portion 20 extends between the exit portion 16 and a smooth bore 22 of a flared section 24 that interconnects cup 14 and handle 12.

The patterned inner wall portion 20 consists of a series of spaced apart grooves 28, each extending from the top edge 26 of the patterned portion 20 to a bottom edge 30 of the patterned portion. Spaced apart grooves 32 are formed to extend around the interior of cup 14 and within the patterned portion 20. Lands 34 are formed between the intersecting grooves 28 and 32 and each of the lands 24 projects slightly inwardly, into cup 14 from the inner wall of the cup.

It has been found that when a hard-packed, and particularly when an icy or slushy snowball is formed in cup 14, it will be thrown from the cup, as will be further explained. The patterned portion 20 somewhat loosens and breaks up the outer surface of the snowball that has been packed into the grooves and around the lands, as the snowball slides from the grooves and past the lands. This reduces the possibility of injury to a person hit by the thrown snowball. The smooth inner bore wall portion 16 directs all broken pieces of a thrown snowball to maintain all pieces of the thrown snowball in a somewhat looser, but still collective mass. A desired degree of accuracy is maintained during flight of the formed snowball, even though the density of the thrown snowball has been reduced during release from the patterned portion 20. The lands and intersecting grooves of the patterned portion 20 are not intended to, and do not fully break up a packed snowball discharged from cup 14. Rather, the lands and intersecting grooves loosen snow only at the surface of the snowball. The loosened material does not then fall away from the snowball, but instead is made to follow the path of the smaller central mass of the snowball, being directed by the smooth inner bore wall portion 16, through which the snowball passes immediately before discharge.

Handle 12 is hollow and is made sufficiently long to allow a user to grasp the handle by one or both hands. The end of the handle remote from cup 14 preferably is formed with spaced apart rings 40 to limit sliding of the handle from the grasping hand of a user.

A hole 42 extends through the wall 44 of handle 12.

The knob 16 formed at the end of handle remote from cup 14 extends outwardly of the handle wall 44 to provide a stop that will prevent the handle from slipping from the grasp of a user. The knob has a concave inner wall surface 48 that extends from a rim 50 of the knob to the bottom 54 of the handle. A hole 56 extends through the bottom of the handle and interconnects the hollow interior of the handle with the concave surface 40 of the knob.

A tapered plug 62 projects from a backing surface 64, and the backing surface 64 is connected by a tether line 66 to an ear 68 projecting outwardly from the knob 16. One end of the tether line 66 is tied through a hole 70 in the backing surface 64 and the other end of the tether line is tied through the ear 68. The tether line 66 is sufficiently long to allow the small end of tapered plug 62 to be selectively inserted into either hole 42 or the hole 56 so that the inserted plug seals the holes.

In using the toy 10, plug 62 is selectively inserted into hole 42 or hole 56, or is removed from both holes to be held by the tether line 66.

During forming and throwing of a snowball, the cup 14 is inserted, open end first into snow until the snow is packed in the cup. The toy 10 is grasped by handle 44 and the user swings the toy in an arc in the manner in which a person swings a tennis racquet. The snowball is frictionally held in the cup until the momentum of the snowball causes it to fly from the cup. The lands 34 and grooves 28 and 32 of the patterned portion 20 of the cup inner wall serve to initially fractionally hold the formed snowball in the cup and to break up the outer surface of the snowball as the snowball slides from the cup. The smooth portion 12 of the inner surface of the cup then directs material loosened from the outer surface of the snowball to fly along with and in the same direction as the center mass of the snowball, as has been previously described.

By inserting plug 62 into hole 56 before swinging the toy to discharge the formed snowball, i.e., either before or after formation of the snowball, the toy is readied to provide a controlled vacuum in the handle as the ball is released. The controlled vacuum is achieved by the user placing a thumb or finger over the hole 42 prior to swinging the toy to discharge the snowball. The thumb or finger is then released as the toy is pointed in the general direction of a target, or at an optimum point in the arc of the swing to obtain maximum distance of the discharged snowball.

Better control of the discharging snowball is thus obtained by closing of the hole 56 with the plug 62, and then closing hole 42 until it is reopened to achieve a desired flight path of the snowball 72.

As shown in FIG. 9, with plug 62 removed from both holes 56 and 42, the user can also use the toy 10 as a "bugle". In so using the toy, the user's lips are placed against the rim 50 of knob 16 and the user blows through the hole 56, handle 12 and cup 14 to provide a discharging sound. The sound pitch is varied by selectively opening or closing the hole 42 with a finger.

The toy 10 serves as a safer snowball forming and throwing toy with improved throwing control and may also serve as a noise maker having a controlled bugle sound. The toy is preferably molded of plastic, or the like.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A snowball forming and throwing toy, comprising an elongate hollow handle; and a cup on one end of said handle, said cup including a flared portion extending from said handle, an enlarged portion extending from said flared portion, and said enlarged portion having an interior smooth wall portion adjacent an open end of said cup and a patterned wall portion between said flared portion and said interior smooth wall projecting slightly into said cup beyond the smooth interior wall portion.

2. A snowball forming and throwing toy as in claim 1, further including a knob at the end of the handle opposite the cup.

3. A snowball forming and throwing toy as in claim 2, further including a hole through the knob, opening into the hollow handle;

a hole through a wall of the handle;

plug means sized to selectively close said hole through said knob or said hole through the wall of the handle; and tether means securing said plug to said handle such that said plug is selectively insertable into each of said holes.

4. A snowball forming and throwing toy as in claim 3, made from plastic.

5. A snowball forming and throwing toy, comprising an elongate hollow handle;

a cup on one end of said handle, said cup including a flared portion extending from said handle, an enlarged portion extending from said flared portion to an open end;

a knob at the end of the handle opposite the cup;

a hole through the knob, opening into the hollow handle;

a hole through a wall of the handle; and plug means sized to selectively close said hole through said knob or said hole through the wall of the handle.

6. A snowball forming and throwing toy as in claim 5, further including tether means securing said plug to said handle such that the plug is selectively insertable into each of said holes.

7. A snowball forming and throwing toy as in claim 6, wherein the enlarged portion of the cup has an interior smooth wall portion adjacent the open end of the cup and a patterned wall portion between the flared portion and the interior smooth wall portion, the patterned portion having intersecting grooves and lands projecting slightly into said cup beyond the smooth interior wall portion.

8. A snowball forming and throwing toy as in claim 7, made of plastic.

* * * * *